US009721585B2

(12) United States Patent
Inoue et al.

(10) Patent No.: US 9,721,585 B2
(45) Date of Patent: Aug. 1, 2017

(54) SIGNAL PROCESSING APPARATUS, SIGNAL PROCESSING METHOD, AND PROGRAM

(75) Inventors: Akira Inoue, Tokyo (JP); Akihiro Mukai, Chiba (JP)

(73) Assignee: Sony Corporation, Tokyo (JP)

( * ) Notice: Subject to any disclaimer, the term of this patent is extended or adjusted under 35 U.S.C. 154(b) by 470 days.

(21) Appl. No.: 13/479,741

(22) Filed: May 24, 2012

(65) Prior Publication Data

US 2012/0310653 A1 Dec. 6, 2012

(30) Foreign Application Priority Data

May 31, 2011 (JP) ..... 2011-122193

(51) Int. Cl.

| | |
|---|---|
| ***G10L 19/00*** | (2013.01) |
| ***G10L 21/00*** | (2013.01) |
| ***G10L 21/04*** | (2013.01) |
| ***G10L 21/043*** | (2013.01) |
| *G10L 25/90* | (2013.01) |

(52) U.S. Cl.

CPC ..... *G10L 21/043* (2013.01); *G10L 25/90* (2013.01)

(58) Field of Classification Search

None

See application file for complete search history.

(56) References Cited

U.S. PATENT DOCUMENTS

| | | | | |
|---|---|---|---|---|
| 5,611,018 | A * | 3/1997 | Tanaka | G10L 21/04 704/208 |
| 6,477,553 | B1 * | 11/2002 | Druck | H03M 1/1265 341/123 |
| 6,539,065 | B1 * | 3/2003 | Furukawa | H04H 40/18 375/259 |
| 6,675,141 | B1 * | 1/2004 | Inoue | G10L 21/04 381/101 |
| 7,336,208 | B2 * | 2/2008 | Van Den Enden | H03H 17/0685 341/61 |
| 8,473,298 | B2 * | 6/2013 | Rogers | G10L 19/26 700/94 |
| 2002/0008776 | A1 * | 1/2002 | Kuzumoto et al. | 348/468 |
| 2002/0087776 | A1 * | 7/2002 | Hofer | G06F 1/183 710/301 |
| 2004/0069118 | A1 * | 4/2004 | Okazaki | G10H 7/02 84/603 |

(Continued)

*Primary Examiner* — Richemond Dorvil
*Assistant Examiner* — Thuykhanh Le
(74) *Attorney, Agent, or Firm* — Paratus Law Group, PLLC

(57) ABSTRACT

A processing buffer unit stores an audio signal. A pitch calculation unit and a pitch cycle correction unit calculate a multiple of N as the number of samples in a pitch cycle of the audio signal, in which N is an integer equal to or more than 1. A processing control unit and a start-position movement amount correction unit sequentially determine, as a sample in a start position of a compression process in a time axis domain of the audio signal, a (multiple of N)-th sample from a start position immediately before the start position. An operation unit compresses samples in a predetermined number times the pitch cycle from the sample in the start position in a time axis domain, and sets the number of samples after the compression to be the multiple of N. The present technology, for example, may be applied to an audio signal processing apparatus.

8 Claims, 11 Drawing Sheets

(56) References Cited

U.S. PATENT DOCUMENTS

| | | | | |
|---|---|---|---|---|
| 2004/0250324 | P1 * | 12/2004 | Jauchen | A01H 5/0222 |
| 2006/0080109 | A1 * | 4/2006 | Kakuno | G10L 19/167 704/500 |
| 2006/0273938 | A1 * | 12/2006 | Van Den Enden | H03H 17/0685 341/61 |
| 2007/0201656 | A1 * | 8/2007 | Lakaniemi | G10L 21/01 379/201.01 |
| 2009/0074204 | A1 * | 3/2009 | Nakamura | G10L 21/04 381/98 |
| 2011/0132179 | A1 * | 6/2011 | Saino | G10H 1/0008 84/622 |
| 2011/0279324 | A1 * | 11/2011 | Bolotski | G01S 19/30 342/451 |
| 2012/0101829 | A1 * | 4/2012 | Hunt | G06Q 90/00 705/1.1 |

* cited by examiner

SIGNAL PROCESSING APPARATUS, SIGNAL PROCESSING METHOD, AND PROGRAM

BACKGROUND

The present technology relates to a signal processing apparatus, a signal processing method, and a program, and particularly to a signal processing apparatus, a signal processing method, and a program in which an audio signal is decompressed or compressed through a time axis domain process.

As a time axis domain decompression and compression algorithm for an audio signal, Pointer Interval Controlled OverLap and Add (PICOLA) that is a simple process and obtains a processing result of high sound quality is well known and used (e.g., see Morita Naotaka, Itakura Fumitada, "Audio Decompression and Compression in Time Axis Using Pointer Interval Controlled OverLap and Add (PICOLA) based on Pointer Movement Amount Control, and Evaluation Thereof," Proceedings of the Acoustical Society of Japan, issued October 1986, p. 149-150).

FIG. 1 is a block diagram showing an example of a configuration of a playback speed conversion apparatus for compressing an audio signal through a time axis domain process according to a PICOLA algorithm.

A playback speed conversion apparatus 10 of FIG. 1 includes a recording unit 11, a processing buffer unit 12, a pitch calculation unit 13, an operation unit 14, a processing control unit 15, and an accumulation unit 16. A playback speed of an audio signal is multiplied by R (R>1).

The recording unit 11 of the playback speed conversion apparatus 10 records an audio signal that is a Pulse Code Modulation (PCM) signal in time series. The recording unit 11 transfers via Direct Memory Access (DMA) the recorded audio signal to the processing buffer unit 12 in recording order.

The processing buffer unit 12 temporarily stores the audio signal DMA-transferred from the recording unit 11 in reception order. Further, based on a start position P supplied from the processing control unit 15 and a pitch cycle $T_0$ supplied from the pitch calculation unit 13, the processing buffer unit 12 reads an audio signal of samples in twice the pitch cycle $T_0$ from a sample in the start position P.

The start position P is a sample number of a sample in a compression start position, and the sample number is a number given, in order, to each sample of the audio signal in time series stored in the processing buffer unit 12. The pitch cycle $T_0$ is the number of samples in a pitch cycle of the audio signal.

The processing buffer unit 12 supplies the read audio signal as an arithmetic processing signal to the operation unit 14. Further, the processing buffer unit 12 determines a position $P+T_0$ that is a sample number of the $T_0$-th sample from the sample in the start position P based on the start position P and the pitch cycle $T_0$. The processing buffer unit 12 overwrites the stored audio signal of samples in the pitch cycle $T_0$ from the sample in the position $P+T_0$ with an arithmetic processing signal after compression, which is supplied from the operation unit 14.

Further, the processing buffer unit 12 obtains a playback signal length L indicating the number of samples of an audio signal after playback speed conversion using the following Equation (1) based on a playback speed conversion ratio R input from the outside and the pitch cycle $T_0$ supplied from the pitch calculation unit 13.

Further, the playback speed conversion ratio R is a length ratio of the audio signal after playback speed conversion recorded in the accumulation unit 16 to the audio signal before playback speed conversion recorded in the recording unit 11. The playback speed conversion ratio R is input to the processing buffer unit 12 and the processing control unit 15, for example, by a user manipulating an input unit which is not shown.

$$L = T_0 \times \frac{1}{R-1} \tag{1}$$

The processing buffer unit 12 DMA-transfers the audio signal of samples in the playback signal length L from the sample in the position $P+T_0$ containing the audio signal overwritten to the compressed arithmetic processing signal, as the audio signal after playback speed conversion for an audio signal from the sample in the start position P to the sample in the next start position P, to the accumulation unit 16. In this case, when the processing buffer unit 12 does not yet store all of the audio signal of the samples in the playback signal length L from the sample in the position $P+T_0$, the processing buffer unit 12 DMA-transfers only an already stored signal in the entire audio signal to the accumulation unit 16. The processing buffer unit 12 then requests the recording unit 11 to DMA-transfer a remaining audio signal, temporarily stores the audio signal DMA-transferred according to the request, and DMA-transfers the audio signal to the accumulation unit 16.

The pitch calculation unit 13 calculates the pitch cycle $T_0$ of the audio signal by referring to an audio signal of samples in twice a maximum pitch cycle $T_{max}$ that is a maximum value of numbers of samples in a previously set pitch cycle from the sample in the start position P, which is stored in the processing buffer unit 12. Specifically, the pitch calculation unit 13 calculates, as the pitch cycle $T_0$, a period T for minimizing an average distortion d(T) defined, for example, by the following Equation (2) based on the audio signal of the samples in twice the maximum pitch cycle $T_{max}$ from the sample in the start position P. The pitch calculation unit 13 supplies the calculated pitch cycle $T_0$ to the processing buffer unit 12 and the processing control unit 15.

$$d(T) = \frac{1}{T}\sum_{i=0}^{T-1}\{x(i) - x(i+T)\}^2,\ T_{min} \le T \le T_{max} \tag{2}$$

In Equation (2), x(i) denotes an audio signal of the i-th sample in the audio signal of samples in twice the maximum pitch cycle $T_{max}$ from the sample in the start position P. Further, $T_{min}$ denotes a minimum pitch cycle, which is a minimum value of the number of samples in a previously set pitch cycle.

The operation unit 14 performs weighted addition of the audio signal of samples in the pitch cycle $T_0$ from the sample in the start position P in the arithmetic processing signals supplied from the processing buffer unit 12 and the audio signal of samples in the pitch cycle $T_0$ from the sample in the position $P+T_0$. The operation unit 14 supplies the resultant audio signal of the samples in the pitch cycle $T_0$, as a compressed arithmetic processing signal, to the processing buffer unit 12.

The processing control unit 15 determines an initial start position P as a predetermined value (for example, 0). Further, the processing control unit 15 sequentially updates the start position P using the following Equations (3) and (4)

based on the pitch cycle $T_0$ supplied from the pitch calculation unit 13 and the playback speed conversion ratio R input from the outside. The processing control unit 15 supplies the start position P to the processing buffer unit 12.

$$P = P + \Delta P \tag{3}$$

$$\Delta P = T_0 \times \frac{R}{R-1} \tag{4}$$

Since a storage capacity of the processing buffer unit 12 is finite, the audio signal stored in the processing buffer unit 12 is updated at an appropriate timing. Accordingly, in this case, when the processing buffer unit 12 is a ring buffer, the processing control unit 15 updates the start position P using a modulo operation based on a length of the processing buffer unit 12. When the processing buffer unit 12 is not the ring buffer, the processing control unit 15 updates the start position P to be a sufficiently small value (for example, 0).

The accumulation unit 16 accumulates the audio signal of samples in the playback signal length L from the sample in the position $P+T_0$, which is DMA-transferred from the processing buffer unit 12.

On the other hand, in operation or DMA transfer in a Central Processing Unit (CPU), a Digital Signal Processor (DSP), or the like, there is a constraint on an arrangement of data as a processing target. It is assumed that a data amount of an audio signal of one sample is 32 bits (4 bytes). In this case, in order to perform, in parallel, operations in which an audio signal of 4 samples is a processing target, it may be necessary for the audio signal to be aligned to 16 bytes, a data amount for 4 samples. Further, in the DMA transfer, it may be necessary for a start position of a data transfer source or a transfer destination to be aligned to a default number of bytes, such as a power of 2.

SUMMARY

In the DMA transfer the recording unit 11 and the processing buffer unit 12 of the playback speed conversion apparatus 10 of FIG. 1, the weighted addition process in the operation unit 14, and the like, when there is a constraint on an arrangement of the audio signal as a processing target, and if the pitch cycle $T_0$ and the start-position movement amount $\Delta P$ are not multiples of the number of samples corresponding to constraint, it is necessary to perform exceptional processing. As a result, for example, extra instruction code is necessary and a processing amount increases. The same applies to a playback speed conversion apparatus that decompresses an audio signal through a time axis domain process according to a PICOLA algorithm.

The present technology has been made in view of the circumstances described above, and the present disclosure allows a processing amount to be reduced even when there is a constraint on an arrangement of an audio signal as a processing target in a case in which the audio signal is decompressed or compressed through a time axis domain process.

According to an embodiment of the present disclosure, there is provided a signal processing apparatus including: a storage unit for storing an audio signal; a pitch calculation unit for calculating a multiple of N as the number of samples in a pitch cycle of the audio signal, N being an integer equal to or more than 1; a start position determination unit for sequentially determining, as a sample in a start position of a decompression or compression process in a time axis domain of the audio signal, a (multiple of N)-th sample from a start position immediately before the start position; and a decompression and compression unit for decompressing or compressing, in a time axis domain, samples in a predetermined number times the pitch cycle from the sample in the start position of the audio signal, and setting the number of samples of the audio signal after the decompression or the compression to be the multiple of N, wherein the storage unit overwrites a stored audio signal from a (predetermined number times the pitch cycle)-th sample from the start position to samples of the audio signal after decompression or compression, with the audio signal after the decompression or the compression in the decompression and compression unit, and transmits the audio signal after overwriting, from a sample in an overwriting start position.

A signal processing method and a program according to an embodiment of the present technology correspond to a signal processing apparatus according to an embodiment of the present technology.

In an embodiment of the present technology, a multiple of N is calculated as the number of samples in a pitch cycle of the audio signal, N being an integer equal to or more than 1, a (multiple of N)-th sample from a start position immediately before the start position is sequentially determined as a sample in a start position of a decompression or compression process in a time axis domain of the audio signal, samples in a predetermined number times the pitch cycle from the sample in the start position of the audio signal are decompressed or compressed in a time axis domain, and the number of samples of the audio signal after the decompression or the compression is set to be the multiple of N. The audio signal is stored in a storage unit, and the storage unit overwrites a stored audio signal from a (predetermined number times the pitch cycle)-th sample from the start position to samples of the audio signal after decompression or compression, with the audio signal after the decompression or the compression in the decompression and compression unit, and transmits the audio signal after overwriting, from a sample in an overwriting start position.

According to an embodiment of the present technology, when an audio signal is decompressed or compressed through a time axis domain process, a processing amount can be reduced even when there is a constraint on an arrangement of an audio signal as a processing target.

DETAILED DESCRIPTION OF THE EMBODIMENT(S)

Figure 1:
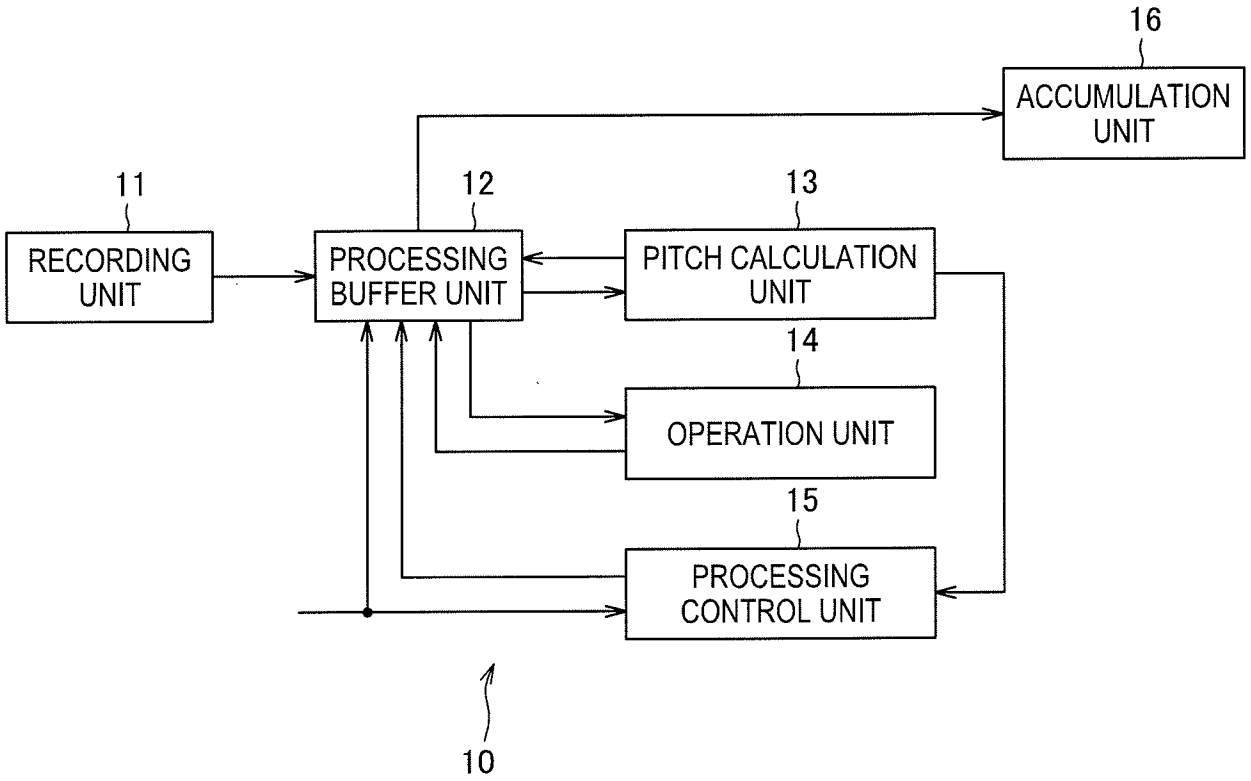
FIG. 1 is a block diagram showing an example of a configuration of a playback speed conversion apparatus in related art.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

First Embodiment

[Example Configuration of First Embodiment of Playback Speed Conversion Apparatus]

Figure 2:
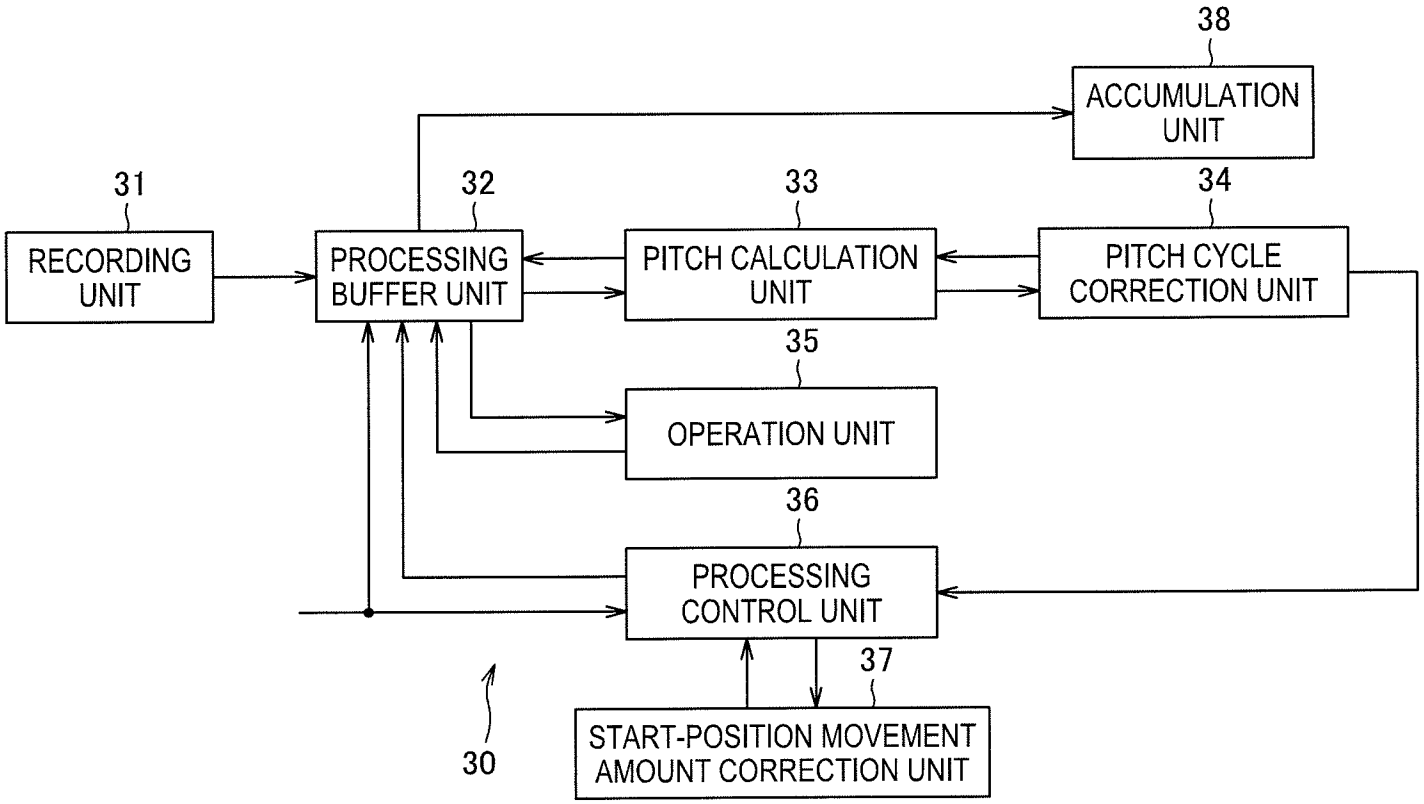
FIG. 2 is a block diagram showing an example configuration of a first embodiment of a playback speed conversion apparatus to which the present technology has been applied.

FIG. 2 is a block diagram showing an example configuration of a first embodiment of a playback speed conversion apparatus as a signal processing apparatus to which the present technology has been applied.

A playback speed conversion apparatus 30 of FIG. 2 includes a recording unit 31, a processing buffer unit 32, a pitch calculation unit 33, a pitch cycle correction unit 34, an operation unit 35, a processing control unit 36, a start-position movement amount correction unit 37, and an accumulation unit 38. A playback speed of an audio signal is R (R>1) times.

Further, in the playback speed conversion apparatus 30 of FIG. 2, the recording unit 31, the processing buffer unit 32, and the accumulation unit 38 have a constraint in that a start position of a processing target of a transfer source and a transfer destination of DMA transfer is aligned to a data amount of an audio signal of N samples. For example, there is a constraint that the start position of the processing target of the transfer source and the transfer destination of DMA transfer is aligned to 16 bytes. In this case, if a data amount of an audio signal of one sample is 32 bits (4 bytes), N is 4. Further, the operation unit 35 has a constraint that a parallel processing target is aligned to a data amount of an audio signal of a parallel number of samples.

The recording unit 31 of the playback speed conversion apparatus 30 records an audio signal that is a PCM signal in time series, similar to the recording unit 11 of FIG. 1. The recording unit 31 DMA-transfers the recorded audio signal to the processing buffer unit 32 in units of N samples in recording order.

Thus, since the recording unit 31 DMA-transfers the recorded audio signal in units of N samples in recording order, the constraint that the start position of the processing target of the transfer source of DMA transfer is aligned to a data amount of the audio signal of N samples is satisfied.

The processing buffer unit 32 functions as a storage unit and temporarily stores the audio signal, DMA-transferred from the recording unit 31, in units of N samples in reception order. Accordingly, the processing buffer unit 32 satisfies the constraint that the start position of the processing target of the transfer destination of DMA transfer is aligned to the data amount of the audio signal of the N samples.

Based on a start position P supplied from the processing control unit 36 and a pitch cycle $T_0$ supplied from the pitch calculation unit 33, the processing buffer unit 32 reads the audio signal of the samples in twice the pitch cycle $T_0$ from the sample in the start position P, similar to the processing buffer unit 12 of FIG. 1. The processing buffer unit 32 supplies the audio signal as an arithmetic processing signal to the operation unit 35, similar to the processing buffer unit 12.

Also, the processing buffer unit 32 determines a position $P+T_0$ based on the start position P and the pitch cycle $T_0$, similar to the processing buffer unit 12. The processing buffer unit 32 overwrites the stored audio signal of samples in the pitch cycle $T_0$ from the sample in the position $P+T_0$ with a compressed arithmetic processing signal supplied from the operation unit 35, similar to the processing buffer unit 12.

Further, the processing buffer unit 32 obtains a playback signal length L using the above-described Equation (1) based on a playback speed conversion ratio R input from the outside and the pitch cycle $T_0$ supplied from the pitch calculation unit 33, similar to the processing buffer unit 12.

The processing buffer unit 32 DMA-transfers the audio signal of samples in the playback signal length L from the sample in the position $P+T_0$ after overwriting, as an audio signal after playback speed conversion for an audio signal from the sample in the start position P to the sample in the next start position P, to the accumulation unit 38, similar to the processing buffer unit 12. In this case, when the processing buffer unit 32 does not yet store all of the audio signal of samples in the playback signal length L from the sample in the position $P+T_0$, the processing buffer unit 32 DMA-transfers only an already stored signal in the entire audio signal to the accumulation unit 38, similar to the processing buffer unit 12. The processing buffer unit 32 requests the recording unit 31 to DMA-transfer a remaining audio signal, temporarily stores the audio signal DMA-transferred according to the request, and DMA-transfers the audio signal to the accumulation unit 38, similar to the processing buffer unit 12.

Here, as will be described later, the start position P and the pitch cycle $T_0$ are corrected to be a multiple of N. Accordingly, the position $P+T_0$ that is a start position of the audio signal DMA-transferred from the processing buffer unit 32 to the accumulation unit 38 is the multiple of N. Thus, the processing buffer unit 32 satisfies the constraint that the start position of the processing target of the transfer source of DMA transfer is aligned to the data amount of the N samples.

The pitch calculation unit 33 and the pitch cycle correction unit 34 function as a pitch calculation unit. Specifically, the pitch calculation unit 33 calculates the pitch cycle $T_0$ using the above-described Equation (2) by referring to the audio signal of samples in twice the maximum pitch cycle $T_{max}$ from the sample in the start position P, which is stored in the processing buffer unit 32, similar to the pitch calculation unit 13 of FIG. 1. The pitch calculation unit 33 supplies the pitch cycle $T_0$ to the pitch cycle correction unit 34. Also, the pitch calculation unit 33 supplies a pitch cycle $T_0$ after correction supplied from the pitch cycle correction unit 34 to the processing buffer unit 32.

The pitch cycle correction unit 34 corrects the pitch cycle $T_0$ supplied from the pitch calculation unit 33 to be the multiple of N using a predetermined method. As a method of correcting the pitch cycle $T_0$ to be the multiple of N, there is a method of dividing the pitch cycle $T_0$ by N, truncating digits after a decimal point and multiplying the resultant value by N. Also, there is a method of dividing the pitch cycle $T_0$ by N, rounding up digits after a decimal point, and multiplying the resultant value by N. Also, there is a method of dividing the pitch cycle $T_0$ by N, rounding off to the nearest whole number, and multiplying the resultant value by N. The pitch cycle correction unit 34 supplies the pitch cycle $T_0$ after correction, which is the multiple of N, to the pitch calculation unit 33 and the processing control unit 36.

The operation unit 35 functions as a decompression and compression unit, and performs a weighted addition process on the arithmetic processing signal supplied from the processing buffer unit 32, in units of N samples in parallel, to compress the arithmetic processing signal at a percentage corresponding to the playback speed conversion ratio R in a time domain. Specifically, the operation unit 35 performs the weighted addition of the audio signal of the samples in the pitch cycle $T_0$ from the sample in the start position P and the audio signal of the samples in the pitch cycle $T_0$ from the sample in the position $P+T_0$ in units of N samples in parallel.

Here, since the pitch cycle $T_0$ has been corrected to be the multiple of N, the number of samples of each of the audio signal of the samples in the pitch cycle $T_0$ from the sample in the start position P and the audio signal of the samples in the pitch cycle $T_0$ from the sample in the position $P+T_0$ is the multiple of N. Accordingly, in the weighted addition process, the constraint that the parallel processing target is aligned to the data amount of the audio signal of the N samples of a parallel number is satisfied.

The operation unit 35 supplies the audio signal of the samples in the pitch cycle $T_0$ obtained as a result of the weighted addition process, as a compressed arithmetic processing signal, to the processing buffer unit 32.

The processing control unit 36 and the start-position movement amount correction unit 37 function as a start position determination unit. Specifically, the processing control unit 36 functions as a determination unit to determine an initial start position P as 0. Further, the processing control unit 36 obtains a start-position movement amount ΔP using the above-described Equation (4) based on the pitch cycle $T_0$ supplied from the pitch calculation unit 33 and the playback speed conversion ratio R input from the outside. The processing control unit 36 supplies the start-position movement amount ΔP. to the start-position movement amount correction unit 37.

Further, the processing control unit 36 sequentially updates the start position P using the above-described Equation (3) based on a start-position movement amount ΔP after correction, which is the multiple of N, supplied from the start-position movement amount correction unit 37. Since the initial start position P is 0 and the start-position movement amount ΔP is the multiple of N, the start position P updated by the above-described Equation (3) is necessarily the multiple of N. The processing control unit 36 supplies the start position P, which is the multiple of N, to the processing buffer unit 32.

The start-position movement amount correction unit 37 functions as a start position correction unit, corrects the start-position movement amount ΔP supplied from the processing control unit 36 to be the multiple of N using a predetermined method, and supplies the start-position movement amount ΔP after correction to the processing control unit 36. As a method of correcting the start-position movement amount ΔP to be the multiple of N, the same method described above for correcting the pitch cycle $T_0$ to be the multiple of N may be used.

However, the start-position movement amount correction unit 37 selects a method of correcting the start-position movement amount ΔP to be the multiple of N based on a cumulative error sum error_sum that is a cumulative sum of a difference obtained as a result of subtracting the start-position movement amount ΔP before correction from the start-position movement amount ΔP after correction.

For example, when the cumulative error sum error_sum is a positive value, i.e., the start-position movement amount ΔP after correction tends to be greater than the start-position movement amount ΔP before correction, the start-position movement amount correction unit 37 selects a method of performing correction by dividing the start-position movement amount ΔP by N, truncating digits after a decimal point, and multiplying the resultant value by N. Accordingly, the start position P updated using the start-position movement amount ΔP after correction becomes smaller than the start position P updated using the start-position movement amount ΔP before correction. That is, a position of a sample in the start position P updated using the start-position movement amount ΔP is corrected to be a preceding position.

On the other hand, when the cumulative error sum error_sum is a negative value, i.e., when the start-position movement amount ΔP after correction is smaller than the start-position movement amount ΔP before correction, a method of performing correction by multiplying the start-position movement amount ΔP by N, rounding up digits after a decimal point, and multiplying by N is selected. Accordingly, the start position P updated using the start-position movement amount ΔP after correction is greater than the start position P updated using the start-position movement amount ΔP before correction. That is, the position of the sample in the start position P updated using the start-position movement amount ΔP is corrected to be a subsequent position.

As described above, since the start-position movement amount correction unit 37 selects the method in which the cumulative error sum error_sum becomes small, the cumulative value of the start-position movement amount ΔP after correction becomes close to the cumulative value of the start-position movement amount ΔP before correction. As a result, a ratio of a total sum of numbers of samples of audio signals after playback speed conversion recorded in the accumulation unit 38 to a total sum of the numbers of sample of audio signals recorded in the recording unit 31 becomes close to a desired playback speed conversion ratio R.

Further, the start-position movement amount correction unit 37 obtains (updates) and holds the cumulative error sum error_sum using the following Equation (5). This cumulative error sum error_sum is used to select a method of correcting the next start-position movement amount ΔP, as described above.

$$\text{error_sum}=\text{error_sum}(\Delta P_{after}-\Delta P_{before}) \quad (5)$$

In Equation (5), $\Delta P_{after}$ denotes the start-position movement amount ΔP after correction and $\Delta P_{before}$ denotes the start-position movement amount ΔP before correction.

The accumulation unit 38 has a function of accumulating audio signals in time series. The accumulation unit 38 accumulates the audio signal after playback speed conversion DMA-transferred from the processing buffer unit 32, as an audio signal of a corresponding time.

Here, a position $P+T_0$ that is a sample number of a leading sample of the audio signal after playback speed conversion, which is DMA-transferred from the processing buffer unit 32, is the multiple of N, as described above. Accordingly, the accumulation unit 38 satisfies the constraint that the start position of the processing target of the transfer destination of DMA transfer is aligned to the data amount of the audio signal of the N samples.

As described above, in the playback speed conversion apparatus 30, each of the recording unit 31, the processing buffer unit 32, the accumulation unit 38, and the operation unit 35 performs each process while satisfying its constraint. Accordingly, each of the recording unit 31, the processing buffer unit 32, the accumulation unit 38, and the operation unit 35 can perform each process as a normal process whose constraint is satisfied. As a result, for example, extra instruction code is not necessary and accordingly a processing amount can be reduced compared to the playback speed conversion apparatus 10 of FIG. 1 in related art.

[Example of Audio Signal]

Figure 3:
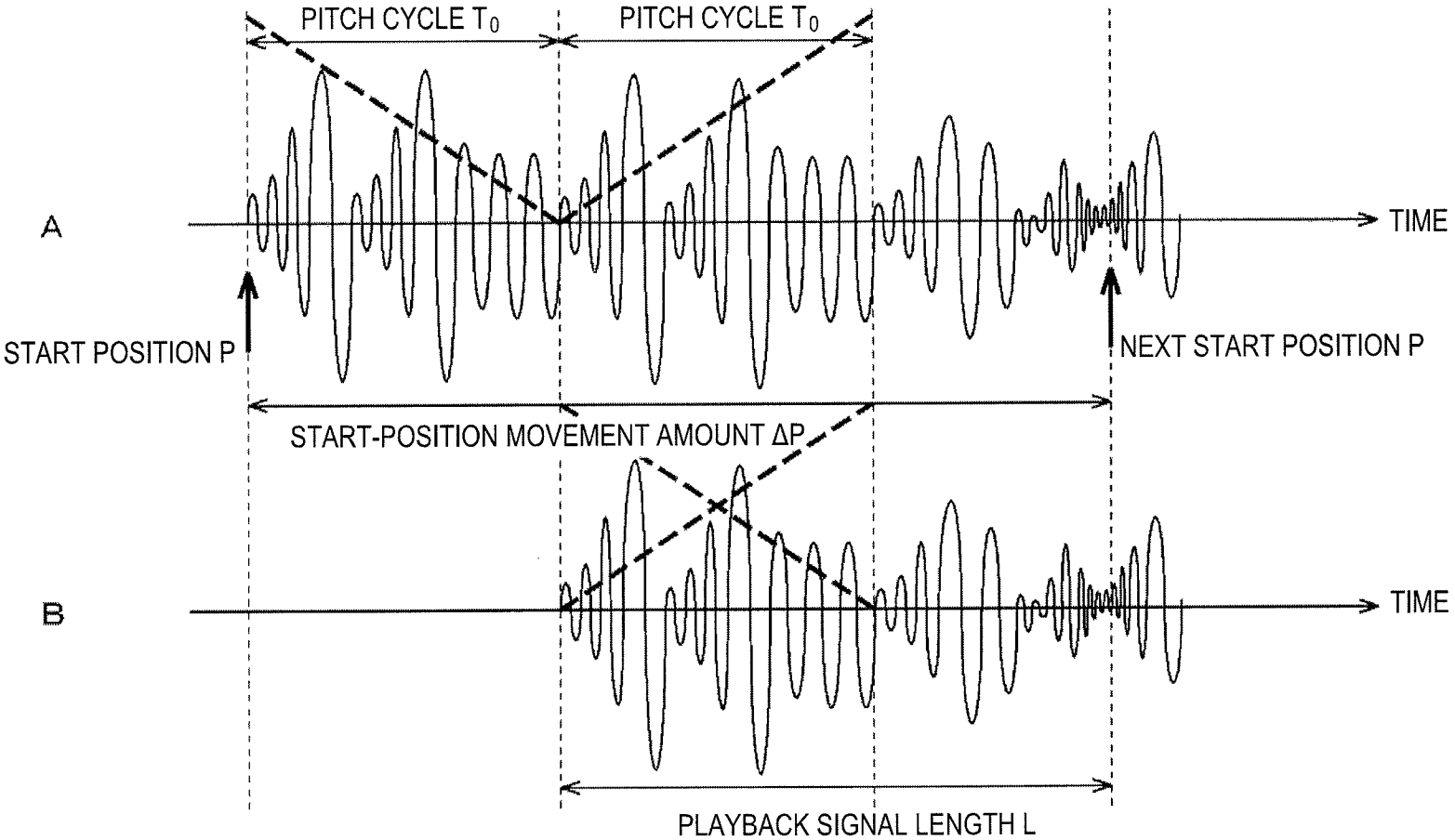
FIG. 3 is a diagram showing an example of an audio signal.

FIG. 3 is a diagram showing examples of the audio signal stored in the processing buffer unit 32 of FIG. 2 and the audio signal accumulated in the accumulation unit 38. In FIG. 3, a horizontal axis indicates time.

As shown in FIG. 3A, the audio signal of samples in the pitch cycle $T_0$ from the sample in the start position P of the audio signal stored in the processing buffer unit 32 is weighted with a predetermined weight gradually decreasing from the sample in the start position P, as indicated by a thick dotted line in FIG. 3A. Also, the audio signal of samples in the pitch cycle $T_0$ from the sample in the position $P+T_0$ is weighted with a predetermined weight gradually increasing from the sample in the position $P+T_0$, as indicated by a thick dotted line in FIG. 3A.

The weighted audio signal of the samples in the pitch cycle $T_0$ from the sample in the start position P and the weighted audio signal of samples in the pitch cycle $T_0$ from the sample in the position $P+T_0$ are added and the audio signal of the samples in the pitch cycle $T_0$ is generated. This audio signal of the samples in the pitch cycle $T_0$ is overwritten to the audio signal of samples in the pitch cycle $T_0$ from the sample in the position $P+T_0$ stored in the processing buffer unit 32.

As a result, the audio signal in the playback signal length L from the sample in the position $P+T_0$, stored in the processing buffer unit 32, becomes as shown in FIG. 3B. That is, an audio signal of samples other than the samples in the pitch cycle $T_0$ from the sample in the position $P+T_0$ in the audio signal of the playback signal length L from the sample in the position $P+T_0$ is the audio signal DMA-transferred from the recording unit 31 as is. This audio signal is DMA-transferred as the audio signal after playback speed conversion to the accumulation unit 38 and accumulated in the accumulation unit 38.

Further, this audio signal after playback speed conversion is for an audio signal of samples of the start-position movement amount $\Delta P$ from the sample in the start position P to the sample in the next start position P, stored in the processing buffer unit 32, as shown in FIG. 3A. Accordingly, a ratio of a playback speed of the audio signal accumulated in the accumulation unit 38 to a playback speed of the audio signal recorded in the recording unit 31 is approximately equal to $\Delta P/L$, i.e., the playback speed conversion ratio R.

[Description of Process in Playback Speed Conversion Apparatus]

Figure 4:
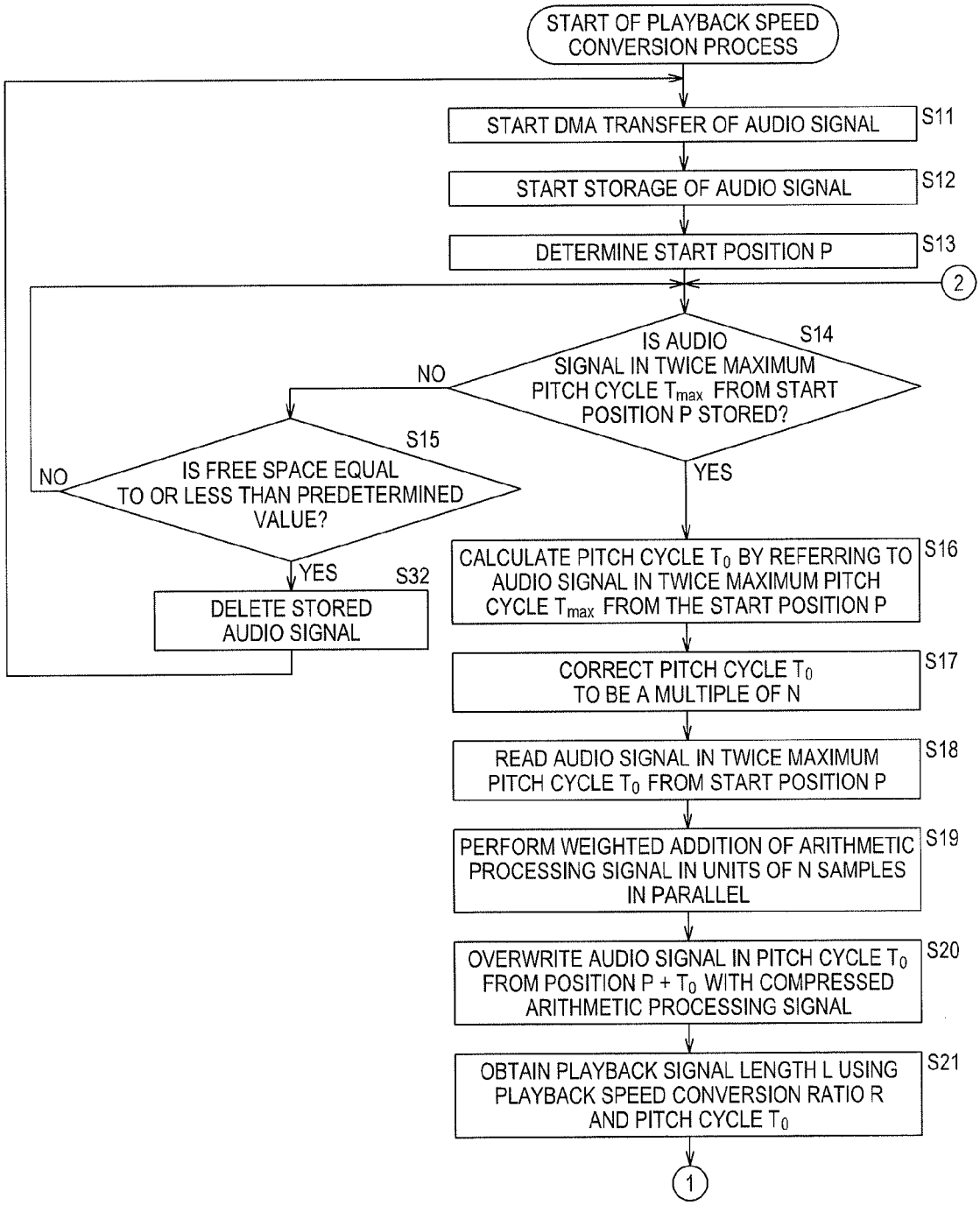
FIG. 4 is a flowchart illustrating a playback speed conversion process in the playback speed conversion apparatus of FIG. 2.
Figure 5:
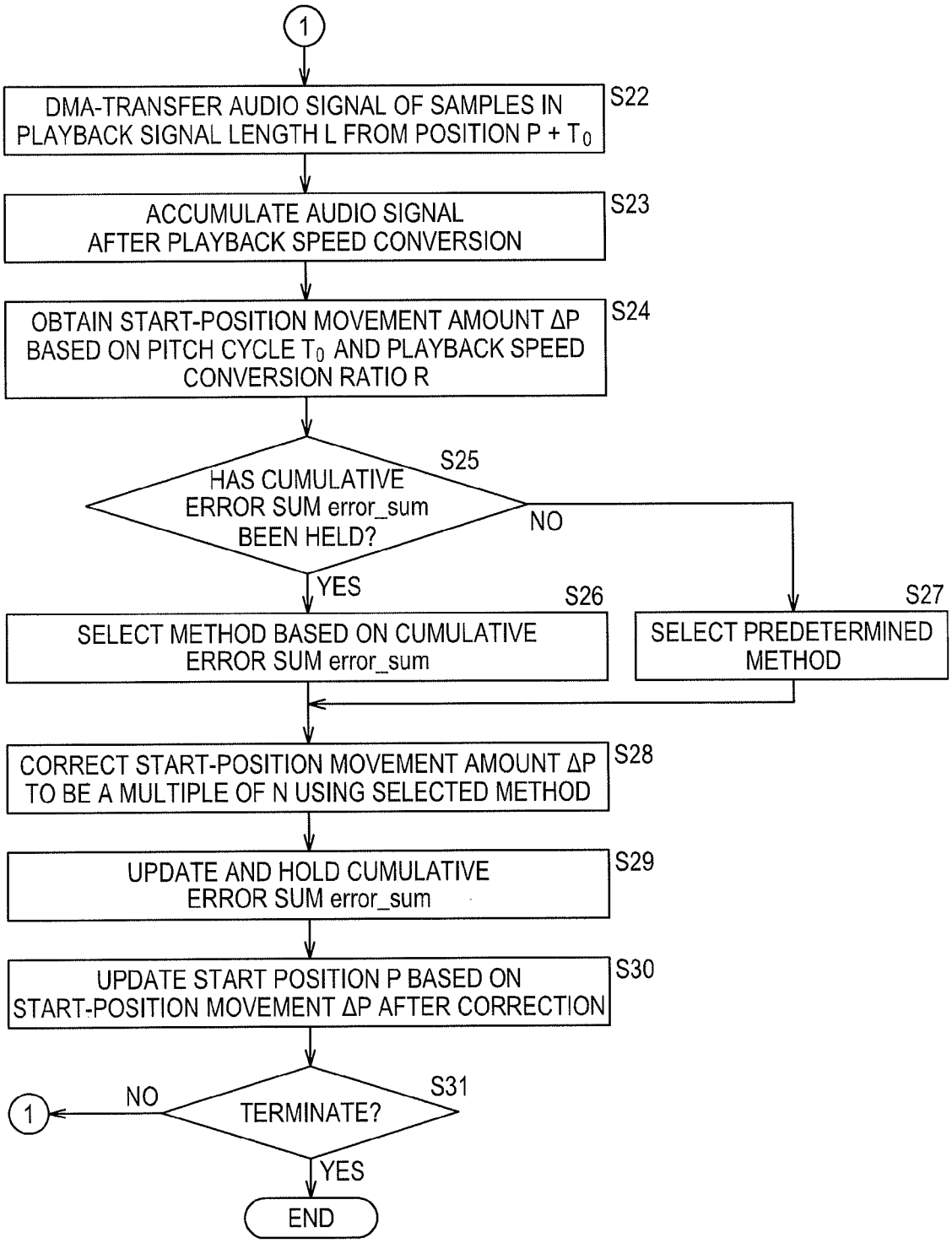
FIG. 5 is a flowchart illustrating a playback speed conversion process in the playback speed conversion apparatus of FIG. 2.

FIGS. 4 and 5 are flowcharts illustrating a playback speed conversion process in the playback speed conversion apparatus 30 of FIG. 2. This playback speed conversion process starts, for example, when a user instructs to start the playback speed conversion process by manipulating an input unit, which is not shown.

In step S11 of FIG. 4, the recording unit 31 of the playback speed conversion apparatus 30 starts DMA transfer of the recorded audio signal to the processing buffer unit 32 in units of N samples, and performs the DMA transfer until a free capacity of the processing buffer unit 32 is equal to or less than a predetermined value.

In step S12, the processing buffer unit 32 starts temporary storage of the audio signal in units of N samples, which is DMA-transferred from the recording unit 31.

In step S13, the processing control unit 36 determines the initial start position P to be a predetermined value (e.g., 0).

In step S14, the processing buffer unit 32 determines whether the audio signal of samples is twice the maximum pitch cycle $T_{max}$ from the sample in the start position P has been stored.

If it is determined in step S14 that the audio signal of samples in twice the maximum pitch cycle $T_{max}$ from the sample in the start position P has not yet been stored, the process proceeds to step S15.

In step S15, the processing buffer unit 32 determines whether its free space is equal to or less than the predetermined value. If it is determined in step S15 that the free space is not equal to or less than the predetermined value, the processing buffer unit 32 waits until the audio signal of samples in twice the maximum pitch cycle $T_{max}$ from the sample in the start position P are stored.

On the other hand, if it is determined in step S14 that the audio signal of the samples in twice the maximum pitch cycle $T_{max}$ from the sample in the start position P has been stored, the process proceeds to step S16. In step S16, the pitch calculation unit 33 calculates the pitch cycle $T_0$ of the audio signal using the above-described Equation (2) by referring to the audio signal of the samples in twice the maximum pitch cycle $T_{max}$ from the sample in the start position P, which has been stored in the processing buffer unit 32. The pitch calculation unit 33 supplies the pitch cycle $T_0$ to the pitch cycle correction unit 34.

In step S17, the pitch cycle correction unit 34 corrects the pitch cycle $T_0$ to be the multiple of N using a predetermined method. The pitch cycle correction unit 34 supplies the pitch cycle $T_0$ after correction, which is the multiple of N, to the pitch calculation unit 33 and the processing control unit 36. The pitch calculation unit 33 supplies the pitch cycle $T_0$ after correction supplied from the pitch cycle correction unit 34 to the processing buffer unit 32.

In step S18, the processing buffer unit 32 reads the audio signal of the samples in twice the pitch cycle $T_0$ from the sample in the start position P based on the start position P supplied from the processing control unit 36 and the pitch cycle $T_0$ supplied from the pitch calculation unit 33. The processing buffer unit 32 supplies the audio signal as an arithmetic processing signal to the operation unit 35.

In step S19, the operation unit 35 performs weighted addition of the arithmetic processing signal supplied from the processing buffer unit 32 in units of N samples in parallel.

Specifically, the operation unit 35 performs the weighted addition of the audio signal of samples in the pitch cycle $T_0$ from the sample in the start position P and the audio signal of samples in the pitch cycle $T_0$ from the sample in the position $P+T_0$ in units of N samples in parallel. The operation unit 35 supplies the resultant audio signal of the samples in the pitch cycle $T_0$ as the compressed arithmetic processing signal to the processing buffer unit 32.

In step S20, the processing buffer unit 32 determines a position $P+T_0$ based on the start position P and the pitch cycle $T_0$, and overwrites the stored audio signal of samples in the pitch cycle $T_0$ from the sample in the position $P+T_0$ with the compressed arithmetic processing signal from the operation unit 35.

In step S21, the processing buffer unit 12 obtains the playback signal length L using the above-described Equation (1) based on the playback speed conversion ratio R input from the outside and the pitch cycle $T_0$ supplied from the pitch calculation unit 33.

In step S22 of FIG. 5, the processing buffer unit 32 DMA-transfers the audio signal of samples in the playback signal length L from the sample in the position $P+T_0$ containing the audio signal overwritten with the compressed arithmetic processing signal, as the audio signal after playback speed conversion, to the accumulation unit 38.

In step S23, the accumulation unit 38 accumulates the audio signal after playback speed conversion DMA-transferred from the processing buffer unit 32 as an audio signal of a corresponding time.

In step S24, the processing control unit 36 obtains the start-position movement amount ΔP using the above-described Equation (4) based on the pitch cycle $T_0$ supplied from the pitch calculation unit 33 and the playback speed conversion ratio R input from the outside. The processing control unit 36 supplies the start-position movement amount ΔP to the start-position movement amount correction unit 37.

In step S25, the start-position movement amount correction unit 37 determines whether a cumulative error sum error_sum has been held.

If it is determined in step S25 that the cumulative error sum error_sum has been held, in step S26, the start-position movement amount correction unit 37 selects a method of correcting the start-position movement amount ΔP to be the multiple of N based on the cumulative error sum error_sum, and the process proceeds to step S28.

On the other hand, if it is determined in step S25 that the cumulative error sum error_sum has not been held, in step S27, the start-position movement amount correction unit 37 selects a predetermined method as the method of correcting the start-position movement amount ΔP to be the multiple of N and the process proceeds to step S28.

In step S28, the start-position movement amount correction unit 37 corrects the start-position movement amount ΔP to be the multiple of N using the method selected in the process of step S26 or S27, and supplies the start-position movement amount ΔP after correction to the processing control unit 36.

In step S29, the start-position movement amount correction unit 37 updates and holds the cumulative error sum error_sum based on the start-position movement amount $\Delta P_{before}$ before correction obtained in the process of the previous step S24 and the start-position movement amount $\Delta P_{after}$ after correction corrected in the process of step S28 using the above-described Equation (5).

In step S30, the processing control unit 36 updates the start position P using the above-described Equation (3) based on the start-position movement amount ΔP after correction, which is the multiple of N, supplied from the start-position movement amount correction unit 37.

In step S31, the pitch calculation unit 33 determines whether the playback speed conversion process ends, for example, whether the user instructs to terminate the playback speed conversion process. If it is determined in step S31 that the playback speed conversion process does not end, the process returns to step S14 of FIG. 4.

On the other hand, if it is determined in step S15 that the free capacity is equal to or less than a predetermined value, the processing buffer unit 32 deletes the stored audio signal in step S32. The process returns to step S11, and the recording unit 31 starts DMA transfer to the processing buffer unit 32 in units of N samples from the audio signal of the sample in the start position P, and performs DMA transfer until the free capacity of the processing buffer unit 32 is equal to or less than the predetermined value. The process proceeds to step S12 and the subsequent process is repeated.

Further, if it is determined in step S31 that the playback speed conversion process ends, the recording unit 31 terminates the DMA transfer and the processing buffer unit 32 terminates storage of the audio signal DMA-transferred from the recording unit 31. The process ends.

As described above, since the playback speed conversion apparatus 30 sets the pitch cycle $T_0$ and the start position P to the multiple of N, each of the recording unit 31, the processing buffer unit 32, the accumulation unit 38, and the operation unit 35 can perform each process while satisfying its constraint. Accordingly, each of the recording unit 31, the processing buffer unit 32, the accumulation unit 38, and the operation unit 35 can perform each process as a normal process whose constraint is satisfied. As a result, for example, extra instruction code is not necessary and accordingly the processing amount can be reduced compared to the playback speed conversion apparatus 10 of FIG. 1 in related art.

Further, a ring buffer may be used as the processing buffer unit 32, similar to the processing buffer unit 12.

Second Embodiment

[Example Configuration of Second Embodiment of Playback Speed Conversion Apparatus]

Figure 6:
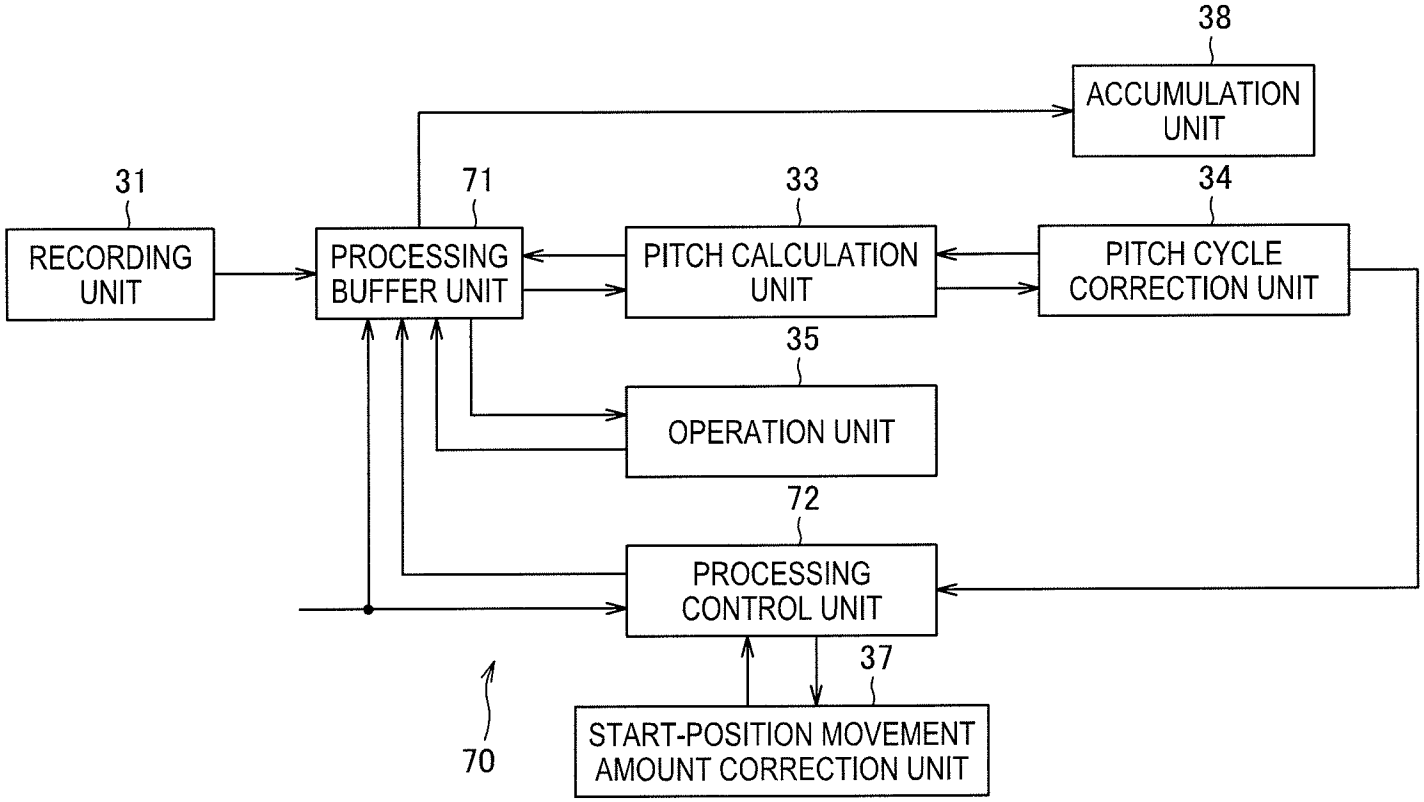
FIG. 6 is a block diagram showing an example configuration of a second embodiment of the playback speed conversion apparatus to which the present technology has been applied.

FIG. 6 is a block diagram showing an example configuration of a second embodiment of the playback speed conversion apparatus as a signal processing apparatus to which the present technology has been applied.

Among components shown in FIG. 6, the same components as those of FIG. 2 are denoted with the same reference numerals. Repeated explanation of these components is appropriately omitted.

The configuration of the playback speed conversion apparatus 70 of FIG. 6 differs from the configuration of FIG. 2, mainly, in that a processing buffer unit 71 and a processing control unit 72 are provided in place of the processing buffer unit 32 and the processing control unit 36. The playback speed conversion apparatus 70 sets a playback speed of an audio signal to R ($0.5<R<1$) times.

Further, in the playback speed conversion apparatus 70 of FIG. 6, a recording unit 31, the processing buffer unit 71, and an accumulation unit 38 have a constraint that a start position of a processing target of a transfer source and a transfer destination of DMA transfer is aligned to a data amount of an audio signal of N samples, similar to the playback speed conversion apparatus 30 of FIG. 2. Further, an operation unit 35 has a constraint that a parallel processing target is aligned to a data amount of an audio signal, of a parallel number of samples.

The processing buffer unit 71 of the playback speed conversion apparatus 70 functions as a storage unit and temporarily stores an audio signal DMA-transferred from the recording unit 31 in units of N samples in reception order, similar to the processing buffer unit 32 of FIG. 2. Accordingly, the processing buffer unit 71 satisfies the constraint that the start position of the processing target of the transfer destination of DMA transfer is aligned to the data amount of the audio signal of the N samples.

Further, based on a start position P supplied from the processing control unit 36 and a pitch cycle $T_0$ supplied from the pitch calculation unit 33, the processing buffer unit 71 DMA-transfers the audio signal from the sample in the start position P to a sample of the pitch cycle $T_0$ to the accumulation unit 38.

Here, the start position P and the pitch cycle $T_0$ are corrected to be a multiple of N by the pitch cycle correction unit 34 and the start-position movement amount correction unit 37. Accordingly, a position P that is a start position of the audio signal from the sample in the start position P to the sample of the pitch cycle $T_0$, which is DMA-transferred from the processing buffer unit 71 to the accumulation unit 38 is the multiple of N. Accordingly, the processing buffer unit 71 satisfies the constraint that the start position of the processing target of the transfer source of DMA transfer is aligned to the data amount of the N samples.

Further, the processing buffer unit 71 reads the audio signal of the samples in twice the pitch cycle $T_0$ from the sample in the start position P based on the start position P supplied from the processing control unit 36 and the pitch cycle $T_0$ supplied from the pitch calculation unit 33, similar to the processing buffer unit 32. The processing buffer unit 72 supplies the audio signal as an arithmetic processing signal to the operation unit 35, similar to the processing buffer unit 32.

Further, the processing buffer unit 71 overwrites the stored audio signal of the samples in the pitch cycle $T_0$ from the sample in the position P with a decompressed arithmetic processing signal subjected to a weighted addition process, which is supplied from the operation unit 35.

Also, the processing buffer unit 71 obtains a playback signal length L using the following Equation (6) based on a playback speed conversion ratio R input from the outside and the pitch cycle $T_0$ supplied from the pitch calculation unit 33.

$$L = T_0 \times \frac{1}{1-R} \tag{6}$$

The processing buffer unit 71 DMA-transfers an audio signal of samples in $L-T_0$ from the sample in the position P after overwriting, as an audio signal other than the previously DMA transferred audio signal in the pitch cycle $T_0$ in an audio signal after playback speed conversion for the audio signal from the sample in the start position P to the sample in the next start position P, to the accumulation unit 38. In this case, when the processing buffer unit 71 has not yet been stored all of the audio signal of the samples in playback signal length $L-T_0$ from the sample in the position P, the processing buffer unit 71 DMA-transfers only a previously stored signal in the entire audio signal to the accumulation unit 38, similar to the processing buffer unit 32. The processing buffer unit 71 requests the recording unit 31 to DMA-transfer a residual audio signal, temporarily stores the audio signal DMA-transferred according to the request, and DMA-transfers the audio signal to the accumulation unit 38, similar to the processing buffer unit 32.

As described above, since the start position P and the pitch cycle $T_0$ are corrected to be the multiple of N by the pitch cycle correction unit 34 and the start-position movement amount correction unit 37, the position P that is the start position of the audio signal of samples in the playback signal length $L-T_0$ from the sample in the position P after overwriting DMA-transferred from the processing buffer unit 71 to the accumulation unit 38 is the multiple of N. Accordingly, the processing buffer unit 71 satisfies the constraint that the start position of the processing target of the transfer source of DMA transfer is aligned to the data amount of the N samples.

The processing control unit 72 and the start-position movement amount correction unit 37 function as a start position determination unit. Specifically, the processing control unit 72 functions as a determination unit to determine an initial start position P as 0, similar to the processing control unit 36 of FIG. 2. Further, the processing control unit 72 obtains the start-position movement amount ΔP using the following Equation (7) based on the pitch cycle $T_0$ supplied from the pitch calculation unit 33 and the playback speed conversion ratio R input from the outside, similar to the processing control unit 36. The processing control unit 72 supplies the start-position movement amount ΔP to the start-position movement amount correction unit 37.

$$\Delta P = T_0 \times \frac{R}{1-R} \tag{7}$$

Further, the processing control unit 72 sequentially updates the start position P using the above-described Equation (3) based on the start-position movement amount ΔP after correction, which is the multiple of N, supplied from the start-position movement amount correction unit 37, similar to the processing control unit 36. Since the initial start position P is 0 and the start-position movement amount ΔP is the multiple of N, the start position P updated using the above-described Equation (3) is necessarily the multiple of N. The processing control unit 72 supplies the start position P that is the multiple of N to the processing buffer unit 71.

As described above, in the playback speed conversion apparatus 70, each of the recording unit 31, the processing buffer unit 71, the accumulation unit 38, and the operation unit 35 performs each process while satisfying its constraint. Accordingly, each of the recording unit 31, the processing buffer unit 71, the accumulation unit 38, and the operation unit 35 can perform each process as a normal process whose constraint is satisfied. As a result, for example, extra instruction code is not necessary and accordingly a processing amount can be reduced compared to the playback speed conversion apparatus 10 of FIG. 1 in related art.

[Example of Audio Signal]

Figure 7:
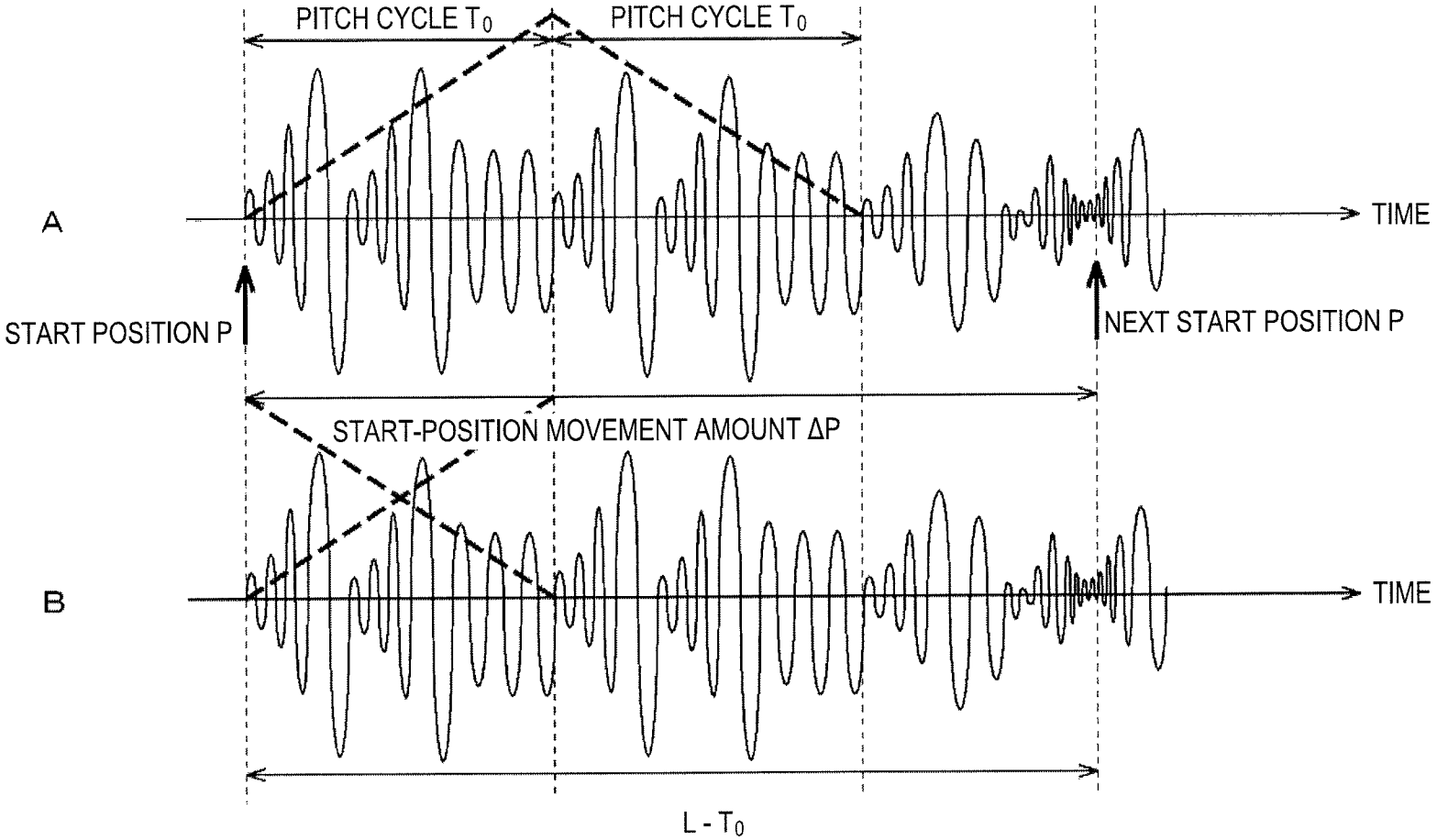
FIG. 7 is a diagram showing an example of an audio signal.

FIG. 7 is a diagram showing an example of the audio signal stored in the processing buffer unit 71 of FIG. 6 and the audio signal accumulated in the accumulation unit 38. In FIG. 7, a horizontal axis indicates time.

First, the audio signal of samples in the pitch cycle $T_0$ from the sample in the start position P in the audio signal stored in the processing buffer unit 71 shown in FIG. 7A is DMA-transferred to and accumulated in the accumulation unit 38 as a part of the audio signal after playback speed conversion.

Next, as shown in FIG. 7A, the audio signal of samples in the pitch cycle $T_0$ from the sample in the start position P in the audio signal stored in the processing buffer unit 71 is weighted with a predetermined weight gradually increasing from the sample in the start position P, as indicated by a thick dotted line in FIG. 7A. Further, the audio signal of samples in the pitch cycle $T_0$ from the sample in the position $P+T_0$ is weighted with a predetermined weight gradually decreasing from the sample in the position $P+T_0$, as indicated by a thick dotted line in FIG. 7A.

The weighted audio signal of the samples in the pitch cycle $T_0$ from the sample in the start position P and the weighted audio signal of the samples in the pitch cycle $T_0$ from the sample in the position $P+T_0$ are added and the audio signal of the samples in the pitch cycle $T_0$ is generated. This audio signal of the samples in the pitch cycle $T_0$ is overwritten to the audio signal of the samples in the pitch cycle $T_0$ from the sample in the position P, which is stored in the processing buffer unit 71.

As a result, the audio signal in $L-T_0$ from the sample in the position P, which is stored in the processing buffer unit 71, is as shown in FIG. 7B. That is, the audio signal of samples other than the samples in the pitch cycle $T_0$ from the sample in the position P in the audio signal in $L-T_0$ from the sample in the position P is the audio signal DMA-transferred from the recording unit 31 as is. This audio signal is DMA-transferred to and accumulated in the accumulation unit 38 as a part not yet DMA-transferred in the audio signal after playback speed conversion.

Further, the audio signal after playback speed conversion is for the audio signal of samples of the start-position movement amount $\Delta P$ from the sample in the start position P to the sample in the next start position P, stored in the processing buffer unit 71, as shown in FIG. 7A. Accordingly, a ratio of a playback speed of the audio signal accumulated in the accumulation unit 38 to a playback speed of the audio signal recorded in the recording unit 31 is approximately equal to $\Delta P/L$, i.e., the playback speed conversion ratio R.

[Description of Process in Playback Speed Conversion Apparatus]

Figure 8:
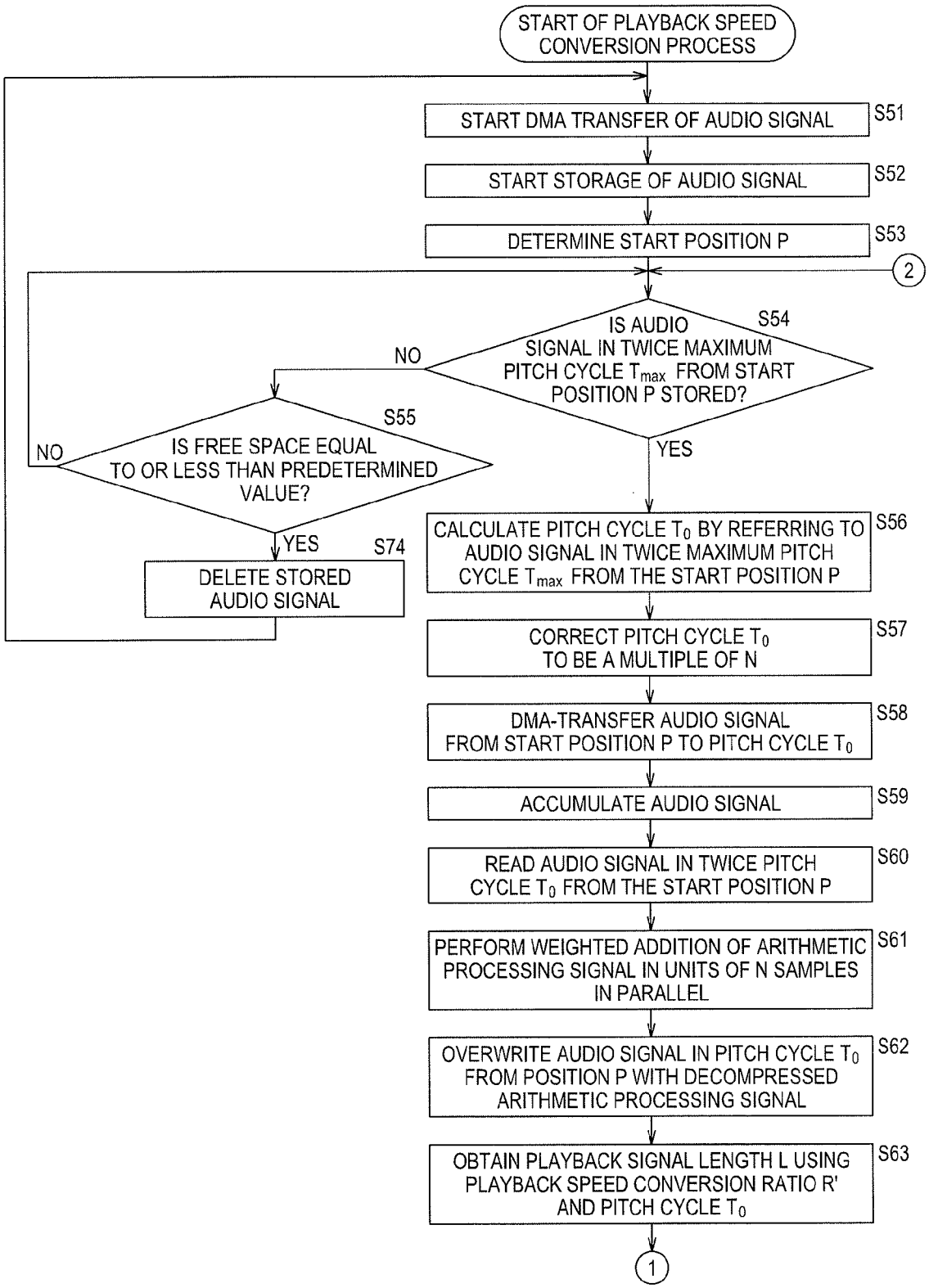
FIG. 8 is a flowchart illustrating a playback speed conversion process in the playback speed conversion apparatus of FIG. 6.
Figure 9:
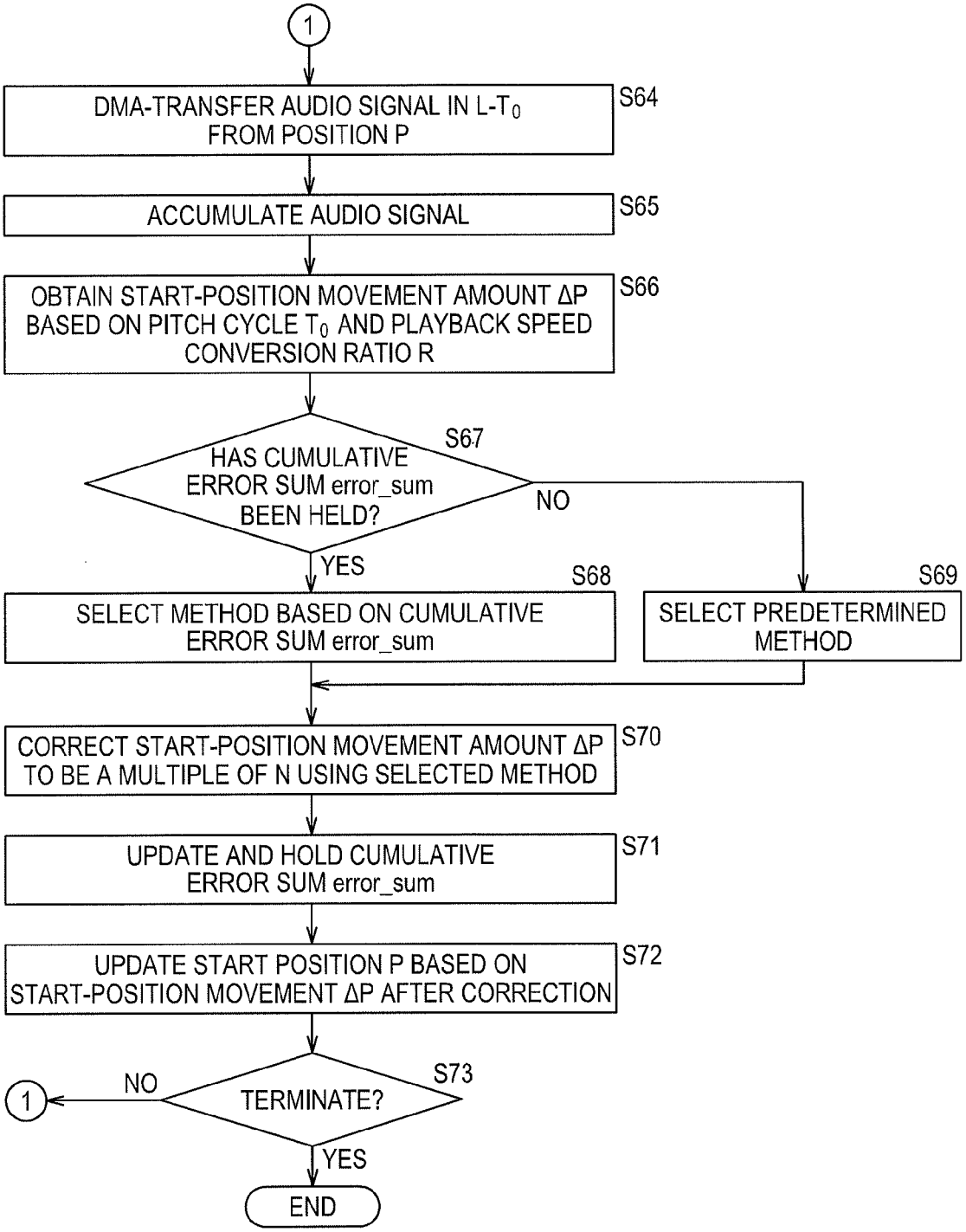
FIG. 9 is a flowchart illustrating a playback speed conversion process in the playback speed conversion apparatus of FIG. 6.

FIGS. 8 and 9 are flowcharts illustrating a playback speed conversion process in the playback speed conversion apparatus 70 of FIG. 6. This playback speed conversion process starts, for example, when a user manipulates an input unit, which is not shown, to instruct to start the playback speed conversion process.

Since a process of steps S51 to S57 in FIG. 8 is the same as the process of steps S11 to S17 in FIG. 4, a description thereof will be omitted.

Following the process in step S57, in step S58, the processing buffer unit 71 DMA-transfers, based on the start position P supplied from the processing control unit 72 and the pitch cycle $T_0$ supplied from the pitch calculation unit 33, an audio signal from the sample in the start position P to the sample of the pitch cycle $T_0$ to the accumulation unit 38.

In step S59, the accumulation unit 38 accumulates the audio signal from the sample in the start position P to the sample of the pitch cycle $T_0$, which is DMA-transferred from the processing buffer unit 71, as a part of the audio signal after the playback speed conversion.

In step S60, the processing buffer unit 71 reads the audio signal of the samples in twice the pitch cycle $T_0$ from the sample in the start position P based on the start position P and the pitch cycle $T_0$. The processing buffer unit 71 supplies the audio signal as the arithmetic processing signal to the operation unit 35.

In step S61, the operation unit 35 performs weighted addition of the arithmetic processing signal supplied from the processing buffer unit 71, in units of N samples in parallel. The operation unit 35 supplies the resultant audio signal of the samples in the pitch cycle $T_0$ as the decompressed arithmetic processing signal to the processing buffer unit 71.

In step S62, the processing buffer unit 71 overwrites the stored audio signal of the samples in the pitch cycle $T_0$ from the sample in the position P with the decompressed arithmetic processing signal from the operation unit 35.

In step S63, the processing buffer unit 71 obtains a playback signal length L using Equation (6) described above using a playback speed conversion ratio R input from the outside and the pitch cycle $T_0$ supplied from the pitch calculation unit 33.

In step S64 of FIG. 9, the processing buffer unit 71 DMA-transfers the audio signal of samples in $L-T_0$ from the sample in the position P, which contains the audio signal overwritten with the decompressed arithmetic processing signal, to the accumulation unit 38.

In step S65, the accumulation unit 38 accumulates the audio signal of samples in $L-T_0$ from the sample in the position P, which is DMA-transferred from the processing buffer unit 71, as an audio signal other than an audio signal in the pitch cycle $T_0$ DMA-transferred in step S58 in the audio signal after playback speed conversion.

Since a process of steps S66 to S74 is the same as that of steps S24 to S32 in FIGS. 4 and 5, a description will be omitted.

As described above, since the playback speed conversion apparatus 70 sets the pitch cycle $T_0$ and the start position P to the multiple of N, each of the recording unit 31, the processing buffer unit 71, the accumulation unit 38, and the operation unit 35 can perform each process while satisfying its constraint. Accordingly, each of the recording unit 31, the processing buffer unit 71, the accumulation unit 38, and the operation unit 35 can perform each process as a normal process whose constraint is satisfied. As a result, for example, extra instruction code is not necessary and accordingly a processing amount can be reduced compared to the playback speed conversion apparatus 10 of FIG. 1 in related art.

Further, a ring buffer may be used as the processing buffer unit 71, similar to the processing buffer unit 12.

Third Embodiment

[Example Configuration of Third Embodiment of Playback Speed Conversion Apparatus]

Figure 10:
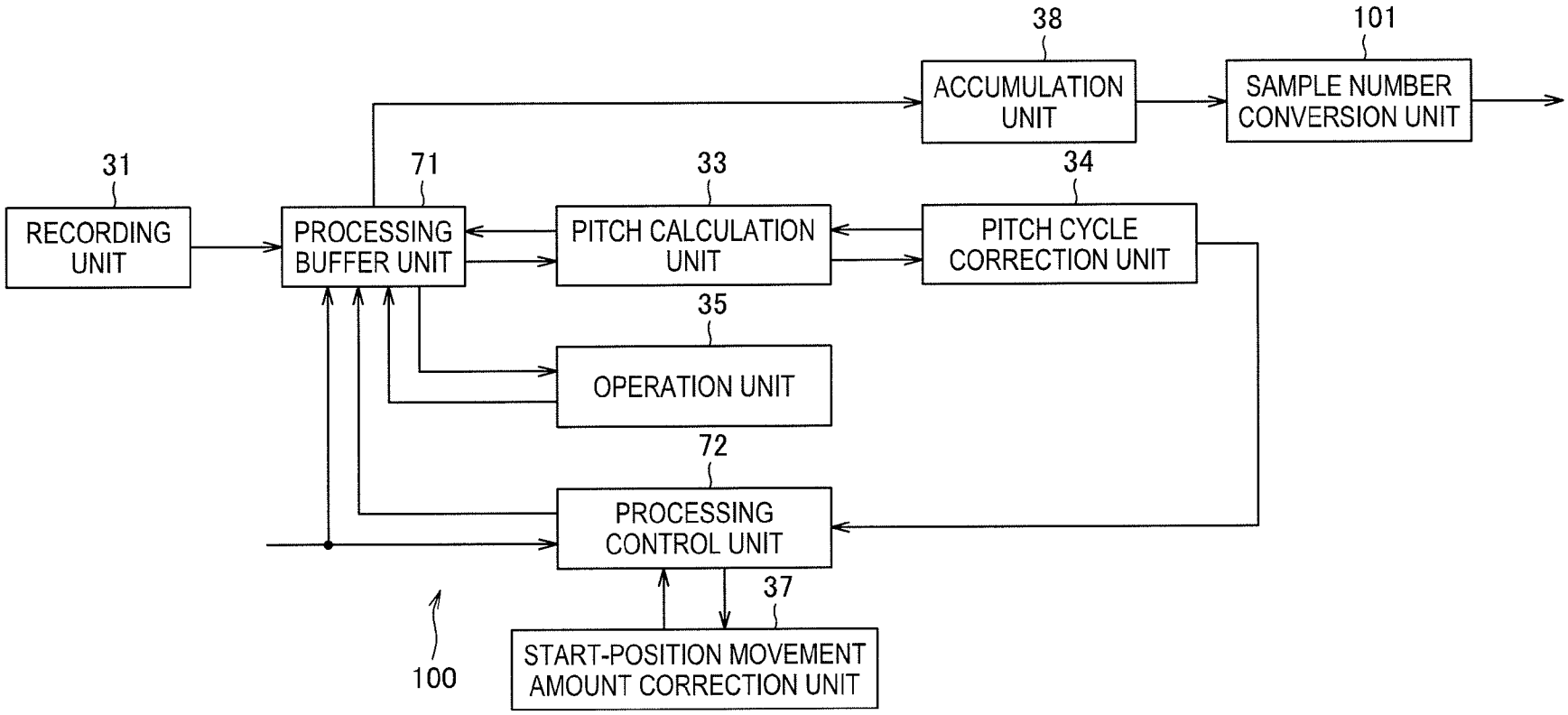
FIG. 10 is a block diagram showing an example configuration of a third embodiment of the playback speed conversion apparatus to which the present technology has been applied.

FIG. 10 is a block diagram showing an example configuration of a third embodiment of a playback speed conversion apparatus as a signal processing apparatus to which the present technology has been applied.

Among components shown in FIG. 10, the same components as those of FIG. 2 are denoted with the same reference numerals. Repeated explanation of these components is appropriately omitted.

A configuration of a playback speed conversion apparatus 100 of FIG. 10 differs from the configuration of FIG. 2, mainly, in that a sample number conversion unit 101 is newly provided. The playback speed conversion apparatus 100 not only changes a playback speed of an audio signal recorded in a recording unit 31, but also changes a pitch cycle.

Specifically, the sample number conversion unit 101 of the playback speed conversion apparatus 100 functions as a changing unit. That is, the sample number conversion unit 101 changes the number of samples of an audio signal after playback speed conversion accumulated in an accumulation unit 38 based on a pitch conversion ratio (which will be described later) input from the outside, to change the pitch cycle, and outputs a changed audio signal.

Further, the pitch conversion ratio is a pitch cycle scaling ratio of an audio signal output from the playback speed conversion apparatus 100 to the audio signal recorded in the recording unit 11. The pitch conversion ratio, for example, is input to the sample number conversion unit 101 by the user manipulating an input unit, which is not shown.

While, in the playback speed conversion apparatus 100 of FIG. 10, an operation unit 35 and the sample number conversion unit 101 are separately provided and compression of the audio signal in a time axis domain and changing of the pitch cycle are separately performed, both may be performed together.

Although not shown, the sample number conversion unit 101 may be provided even in the playback speed conversion apparatus 70 of FIG. 6.

While, in the playback speed conversion apparatus 30 (70 or 100), the pitch cycle $T_0$ is corrected to be the multiple of N after the pitch cycle $T_0$ is calculated, only the pitch cycle $T_0$ that is the multiple of N may be calculated when the pitch cycle $T_0$ is calculated. In this case, the pitch calculation unit 33 performs the operation of the above-described Equation (2) only on the period T that is the multiple of N, and calculates a period T for minimizing average distortion d(T) as the pitch cycle $T_0$.

[Description of Computer to which the Present Technology has been Applied]

Next, a series of processes described above may be performed by hardware or may be performed by software. When the series of processes are performed by the software, a program constituting the software is installed in, for example, a general-purpose computer.

Figure 11:
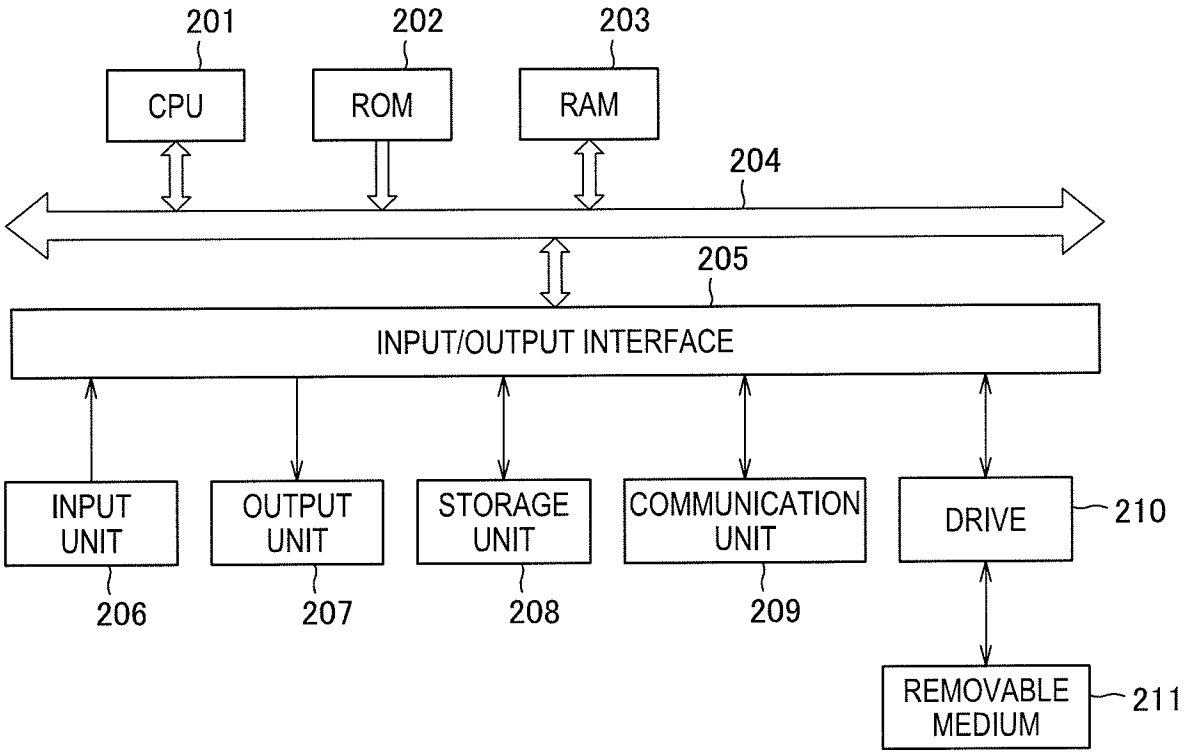
FIG. 11 is a diagram showing an example configuration of an embodiment of a computer.

FIG. 11 shows an example configuration of an embodiment of a computer in which a program for executing the series of processes described above is installed.

The program may be recorded in a storage unit 208 or a Read Only Memory (ROM) 202 as a recording medium embedded in the computer in advance.

Alternatively, the program may be stored (recorded) in a removable medium 211. This removable medium 211 may be provided as so-called package software. Here, examples of the removable medium 211 include a flexible disk, a Compact Disc Read Only Memory (CD-ROM), a Magneto Optical (MO) disk, Digital Versatile Disc (DVD), a magnetic disk, and a semiconductor memory.

Further, the program may be downloaded to the computer via a communication network or a broadcasting network and installed in an embedded storage unit 208, instead of being installed in the computer from the removable medium 211 as described above via a drive 210. That is, the program, for example, may be wirelessly transmitted from a download site to the computer via an artificial satellite for digital broadcasting or transmitted to the computer in a wired manner via a network such as a Local Area Network (LAN) or the Internet.

The computer includes a Central Processing Unit (CPU) 201 therein, and an input/output interface 205 is connected to the CPU 201 via a bus 204.

When the user inputs an instruction by manipulating an input unit 206 via the input/output interface 205, the CPU 201 executes a program stored in the ROM 202 in response to the instruction. Or, the CPU 201 loads and executes a program stored in the storage unit 208 to a Random Access Memory (RAM) 203.

Accordingly, the CPU 201 performs the process according to the above-described flowchart or the process performed by the configuration of the above-described block diagram. The CPU 201, for example, causes the process result to be output from an output unit 207 via the input/output interface 205, to be transmitted from a communication unit 209, or to be recorded in the storage unit 208, as necessary.

Further, the input unit 206 includes a keyboard, a mouse, a microphone or the like. Further, the output unit 207 includes an (Liquid Crystal Display (LCD), a speaker or the like.

Here, in the present disclosure, the process performed by the computer according to the program is not necessarily performed sequentially in order as shown in a flowchart. That is, the process performed by the computer according to the program includes a process executed in parallel or individually (for example, a parallel process or an object-based process).

The program may be a program processed by one computer (processor) or a program processed in a distributed manner by a plurality of computers. Further, the program may be transmitted to a remote computer and executed.

It should be understood by those skilled in the art that various modifications, combinations, sub-combinations and alterations may occur depending on design requirements and other factors insofar as they are within the scope of the appended claims or the equivalents thereof.

Additionally, the present technology can also be configured as below.

(1)

A signal processing apparatus including:

a storage unit for storing an audio signal;

a pitch calculation unit for calculating a multiple of N as the number of samples in a pitch cycle of the audio signal, N being an integer equal to or more than 1;

a start position determination unit for sequentially determining, as a sample in a start position of a decompression or compression process in a time axis domain of the audio signal, a (multiple of N)-th sample from a start position immediately before the start position; and a decompression and compression unit for decompressing or compressing, in a time axis domain, samples in a predetermined number times the pitch cycle from the sample in the start position of the audio signal, and setting the number of samples of the audio signal after the decompression or the compression to be the multiple of N, wherein the storage unit overwrites a stored audio signal from a (predetermined number times the pitch cycle)-th sample from the start position to samples of the audio signal after decompression or compression, with the audio signal after the decompression or the compression in the decompression and compression unit, and transmits the audio signal after overwriting, from a sample in an overwriting start position.

(2)

The signal processing apparatus according to (1), wherein the start position determination unit comprises:

a determination unit for sequentially determining the sample in the start position based on a playback speed conversion ratio that is a length ratio of the audio signal transferred from the storage unit to the audio signal stored in the storage unit; and a start position correction unit for correcting the sample in the start position determined by the determination unit to be a (multiple of N)-th sample from a start position immediately before the start position, and wherein the decompression and compression unit decompresses or compresses, in a time axis domain, samples in the predetermined number times the pitch cycle from the sample in the start position of the audio signal based on the playback speed conversion ratio.

(3)

The signal processing apparatus according to (1) or (2), wherein the pitch calculation unit calculates the number of samples in the pitch cycle in each start position using the audio signal of samples in twice a maximum value of the number of samples in the pitch cycle from the start position.

(4)

The signal processing apparatus according to (1), wherein the start position determination unit comprises:

a determination unit for sequentially determining a predetermined sample as the start position; and a start position correction unit for correcting the sample in the start position determined by the determination unit to be a (multiple of N)-th sample from a start position immediately before the start position, and wherein the start position correction unit calculates a cumulative value of a value obtained by subtracting a movement amount of the start position before correction from a movement amount of the start position after correction, corrects the sample in the start position to be a preceding sample when the cumulative value is a positive value, and corrects the sample in the start position to be a subsequent sample when the cumulative value is a negative value.

(5)

The signal processing apparatus according to any of (1) to (4), wherein the decompression and compression unit performs weighted addition of samples in a predetermined number times the pitch cycle from the sample in the start position of the audio signal in units of N samples in parallel to decompress or compress the samples in a time axis domain.

(6)

The signal processing apparatus according to any of (1) to (5), further including:

a changing unit for changing a pitch cycle of the audio signal after the decompression or the compression in the decompression and compression unit.

(7)

A signal processing method including:

calculating, by a signal processing apparatus including a storage unit for storing an audio signal, a multiple of N as the number of samples in a pitch cycle of the audio signal, N being an integer equal to or more than 1;

sequentially determining, as a sample in a start position of a decompression or compression process in a time axis domain of the audio signal, a (multiple of N)-th sample from a start position immediately before the start position; and decompressing or compressing, in a time axis domain, samples in a predetermined number times the pitch cycle from the sample in the start position of the audio signal, and setting the number of samples of the audio signal after the decompression or the compression to be the multiple of N, wherein the storage unit overwrites a stored audio signal from a (predetermined number times the pitch cycle)-th sample from the start position to samples of the audio signal after decompression or compression, with the audio signal after the decompression or the compression in the decompression and compression step, and transmits the audio signal after overwriting, from a sample in an overwriting start position.

(8)

A program for causing a computer for controlling a signal processing apparatus including a storage unit for storing an audio signal to execute a process including:

calculating a multiple of N as the number of samples in a pitch cycle of the audio signal, N being an integer equal to or more than 1;

sequentially determining, as a sample in a start position of a decompression or compression process in a time axis domain of the audio signal, a (multiple of N)-th sample from a start position immediately before the start position; and decompressing or compressing, in a time axis domain, samples in a predetermined number times the pitch cycle from the sample in the start position of the audio signal, and setting the number of samples of the audio signal after the decompression or the compression to be the multiple of N, wherein the storage unit overwrites a stored audio signal from a (predetermined number times the pitch cycle)-th sample from the start position to the number of samples of the audio signal after decompression or compression, with the audio signal after the decompression or the compression in the decompression and compression step, and transmits the audio signal after overwriting, from a sample in an overwriting start position.

The present disclosure contains subject matter related to that disclosed in Japanese Priority Patent Application JP 2011-122193 filed in the Japan Patent Office on May 31, 2011, the entire content of which is hereby incorporated by reference.

What is claimed is:

1. A signal processing apparatus comprising:

at least one processor;

a storage unit for storing an audio signal using the at least one processor;

a pitch calculation unit for calculating an integer multiple of N as the number of samples in a pitch cycle of the audio signal, N being an integer equal to or more than 1 and representing an amount of sample data equal to a storage constraint of the storage unit, using the at least one processor, wherein the pitch cycle of the audio signal is initially calculated as a period in which an average distortion of the audio signal is minimized within a predetermined minimum threshold amount of the audio signal and a predetermined maximum threshold amount of the audio signal and the initially calculated period represents a non-integer number of samples, and is subsequently corrected to be the integer multiple of N samples;

a start position determination unit for sequentially determining, as a sample in a subsequent start position of a decompression or compression process in a time axis domain of the audio signal, a (multiple of N)-th sample from a prior start position immediately before the subsequent start position using the at least one processor; and a decompression and compression unit for decompressing or compressing, in a time axis domain, samples in a predetermined number times the pitch cycle from the sample in the prior start position of the audio signal, and setting the number of samples of the audio signal after the decompression or the compression to be the same integer multiple of N using the at least one processor, wherein the storage unit overwrites a stored audio signal from a (predetermined number times the pitch cycle)-th sample from the start position to samples of the audio signal after decompression or compression, with the audio signal after the decompression or the compression in the decompression and compression unit, and transmits the audio signal after overwriting, from a sample in an overwriting start position.

2. The signal processing apparatus according to claim 1, wherein the start position determination unit comprises:

a determination unit for sequentially determining the sample in the start position based on a playback speed conversion ratio that is a length ratio of the audio signal transferred from the storage unit to the audio signal stored in the storage unit using the at least one processor; and a start position correction unit for correcting the sample in the start position determined by the determination unit to be a (multiple of N)-th sample from a start position immediately before the start position using the at least one processor, and wherein the decompression and compression unit decompresses or compresses, in a time axis domain, samples in the predetermined number times the pitch cycle from the sample in the start position of the audio signal based on the playback speed conversion ratio using the at least one processor.

3. The signal processing apparatus according to claim 1, wherein the pitch calculation unit calculates the number of samples in the pitch cycle in each start position using the audio signal of samples in twice a maximum value of the number of samples in the pitch cycle from the start position using the at least one processor.

4. The signal processing apparatus according to claim 1, wherein the start position determination unit comprises:

a determination unit for sequentially determining a predetermined sample as the start position using the at least one processor; and a start position correction unit for correcting the sample in the start position determined by the determination unit to be a (multiple of N)-th sample from a start position immediately before the start position using the at least one processor, and wherein the start position correction unit calculates a cumulative value of a value obtained by subtracting a movement amount of the start position before correction from a movement amount of the start position after correction, corrects the sample in the start position to be a preceding sample when the cumulative value is a positive value, and corrects the sample in the start position to be a subsequent sample when the cumulative value is a negative value.

5. The signal processing apparatus according to claim 1, wherein the decompression and compression unit performs weighted addition of samples in a predetermined number times the pitch cycle from the sample in the start position of the audio signal in units of N samples in parallel to decompress or compress the samples in a time axis domain using the at least one processor.

6. The signal processing apparatus according to claim 1, further comprising:

a changing unit for changing a pitch cycle of the audio signal after the decompression or the compression in the decompression and compression unit using the at least one processor.

7. A signal processing method using at least one processor, the method comprising:

calculating, by a signal processing apparatus having the at least one processor and including a storage unit for storing an audio signal, an integer multiple of N as the number of samples in a pitch cycle of the audio signal, N being an integer equal to or more than 1 and representing an amount of sample data equal to a storage constraint of the storage unit, wherein the pitch cycle of the audio signal is initially calculated as a period in which an average distortion of the audio signal is minimized within a predetermined minimum threshold amount of the audio signal and a predetermined maximum threshold amount of the audio signal and the calculated period represents a non-integer number of samples, and is subsequently corrected to be the integer multiple of N samples;

sequentially determining, as a sample in a subsequent start position of a decompression or compression process in a time axis domain of the audio signal, a (multiple of N)-th sample from a prior start position immediately before the subsequent start position using the at least one processor; and decompressing or compressing, in a time axis domain, samples in a predetermined number times the pitch cycle from the sample in the start position of the audio signal, and setting the number of samples of the audio signal after the decompression or the compression to be the same integer multiple of N using the at least one processor, wherein the storage unit overwrites a stored audio signal from a (predetermined number times the pitch cycle)-th sample from the start position to samples of the audio signal after decompression or compression, with the audio signal after the decompression or the compression in the decompression and compression step, and transmits the audio signal after overwriting, from a sample in an overwriting start position.

8. A non-transitory computer-readable storage medium having embodied thereon a program, which when executed by a processor of a computer causes the processor to perform a method for controlling a signal processing apparatus including a storage unit for storing an audio signal to execute a process comprising:

calculating an integer multiple of N as the number of samples in a pitch cycle of the audio signal, N being an integer equal to or more than 1 and representing an amount of sample data equal to a storage constraint of the non-transitory computer-readable storage medium, wherein the pitch cycle of the audio signal is initially calculated as a period in which an average distortion of the audio signal is minimized within a predetermined minimum threshold amount of the audio signal and a predetermined maximum threshold amount of the audio signal and the initially calculated period represents a non-integer number of samples, and is subsequently corrected to be the integer multiple of N samples;

sequentially determining, as a sample in a subsequent start position of a decompression or compression process in a time axis domain of the audio signal, a (multiple of N)-th sample from a prior start position immediately before subsequent the start position; and decompressing or compressing, in a time axis domain, samples in a predetermined number times the pitch cycle from the sample in the prior start position of the audio signal, and setting the number of samples of the audio signal after the decompression or the compression to be the same integer multiple of N, wherein the storage unit overwrites a stored audio signal from a (predetermined number times the pitch cycle)-th sample from the start position to the number of samples of the audio signal after decompression or compression, with the audio signal after the decompression or the compression in the decompression and compression step, and transmits the audio signal after overwriting, from a sample in an overwriting start position.

* * * * *